US011685475B2

(12) United States Patent
Harper

(10) Patent No.: US 11,685,475 B2
(45) Date of Patent: Jun. 27, 2023

(54) METHOD AND SYSTEM FOR SHADING COVER AND SUPPORT

(71) Applicant: Robert Harper, Crested Butte, CO (US)

(72) Inventor: Robert Harper, Crested Butte, CO (US)

( * ) Notice: Subject to any disclaimer, the term of this patent is extended or adjusted under 35 U.S.C. 154(b) by 87 days.

(21) Appl. No.: 17/337,076

(22) Filed: Jun. 2, 2021

(65) Prior Publication Data

US 2021/0371050 A1 Dec. 2, 2021

Related U.S. Application Data

(60) Provisional application No. 63/033,322, filed on Jun. 2, 2020.

(51) Int. Cl.
*B63B 17/02* (2006.01)
*E04H 15/00* (2006.01)

(52) U.S. Cl.
CPC ..... *B63B 17/02* (2013.01); *E04H 15/00* (2013.01)

(58) Field of Classification Search
CPC ..... B63B 17/00; B63B 17/02; E04H 15/00; E04H 15/32; E04H 15/34; E04H 15/42
USPC ..... 114/361; 135/121, 122, 123
See application file for complete search history.

(56) References Cited

U.S. PATENT DOCUMENTS

| | | | | |
|---|---|---|---|---|
| 2,714,387 | A * | 8/1955 | Meldrum | B63B 17/02 114/361 |
| 2,757,387 | A * | 8/1956 | Kelly | A47D 7/04 5/94 |
| 2,757,677 | A * | 8/1956 | Denn | E04H 15/34 135/160 |
| D431,000 | S | 9/2000 | Parks | |
| 7,093,558 | B1 * | 8/2006 | Mandanici | B63B 17/02 114/361 |
| 11,155,323 | B2 * | 10/2021 | Fournier | B63B 17/00 |

* cited by examiner

*Primary Examiner* — Lars A Olson
(74) *Attorney, Agent, or Firm* — Sheridan Ross P.C.

(57) ABSTRACT

Methods and systems for providing coverings and related support structures are provided. In various embodiments, methods and systems of the disclosure are suitable for and well adapted for use with small watercraft such as rafts. Methods and systems of the present disclosure provide a means for quick and easy assembly and disassembly of shadings and coverings as well as convenient storage.

19 Claims, 12 Drawing Sheets

METHOD AND SYSTEM FOR SHADING COVER AND SUPPORT

This U.S. Non-Provisional Patent Applications claims the benefit of priority from U.S. Provisional Patent Application Ser. No. 63/033,322, filed Jun. 2, 2020, the entire disclosure of which is hereby incorporated by reference.

FIELD

The present disclosure relates to coverings and shading devices. In various embodiments, the present disclosure provides methods and systems for providing a canopy and shading device on rafts and small boats.

BACKGROUND

Umbrellas and sunshades provide the often-appreciated function of protecting rafters and boaters from the elements. Whether that protection is from the sun or rain, the use of an umbrella or sunshade can be the difference between enjoying a day on the water and suffering through adverse conditions.

Such umbrellas and sunshades take many forms. One such iteration is the common awning known as a bimini top, which can provide a large area of protection, but involves storage that is often cumbersome. Another iteration is the centrally supported umbrella, which is also awkward, difficult to stow, unstable in wind, and does not provide a large area of protection. Another iteration is the umbrella supported from above by cables, locks, and hinges, which provides a large area of protection and can be stowed in a small area but requires a complex erection process.

SUMMARY

Accordingly, there has been a long-felt and unmet need to provide a covering and/or sunshade that has a large area of protection, can be erected and stowed easily, and can be stowed without interfering with large portions or operations of a raft, boat, or other area to be covered.

Various embodiments of the present disclosure provide methods and systems for a removable and storable shading device suitable for use on rafts and small boats. Although various embodiments of the present disclosure are contemplated for use with boats and watercraft, it will be recognized that embodiments of the present disclosure are not limited to use with such objects and may be provided in combination with various objects including, but not limited to, ground surfaces, furniture and tables, automobiles (truck beds, for example), decks and patios, and any object or environment for which shade and covering is desired.

In various embodiments, systems of the present disclosure comprise a frame member with at least one knuckle that is selectively securable to an object (e.g. coupled to the metal frame of a raft or boat) to secure a covering system to the object. Knuckles of the present disclosure are selectively connected to one or more uprights or vertical supports. A shade member (e.g. a fabric shade member) is provided that comprises holes and grommets operable to secure the shade member to the frame member.

In various embodiments, methods and systems for a removable and storable shading device are provided. Methods and systems of the present disclosure are suitable for use with rafts and small boats, but no limitation with respect to the intended use of embodiments of the present disclosure is provided herewith. In certain embodiments, devices of the present disclosure comprise at least one telescoping upright that detachably couples to a pre-existing object, such as the frame of a raft or boat. In preferred embodiments, a covering or shade member is provided. The covering is contemplated as comprising, but is not limited to, a fabric covering suitable for use as a barrier from the elements (sun, rain, wind, etc.).

The above-described embodiments, objectives, and configurations are neither complete nor exhaustive. As will be appreciated, other embodiments of the invention are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

BRIEF DESCRIPTION OF THE DRAWINGS

The accompanying drawings, which are incorporated in and constitute a part of the specification, illustrate embodiments of the invention and together with the Summary given above and the Detailed Description of the drawings given below, serve to explain the principles of these embodiments. In certain instances, details that are not necessary for an understanding of the invention or that render other details difficult to perceive may have been omitted. It should be understood, of course, that the invention is not necessarily limited to the particular embodiments illustrated herein. Additionally, it should be understood that the drawings are not necessarily to scale.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

DETAILED DESCRIPTION

Embodiments of the present disclosure have significant benefits across a broad spectrum of endeavors. It is the Applicant's intent that this specification be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Figure 1:
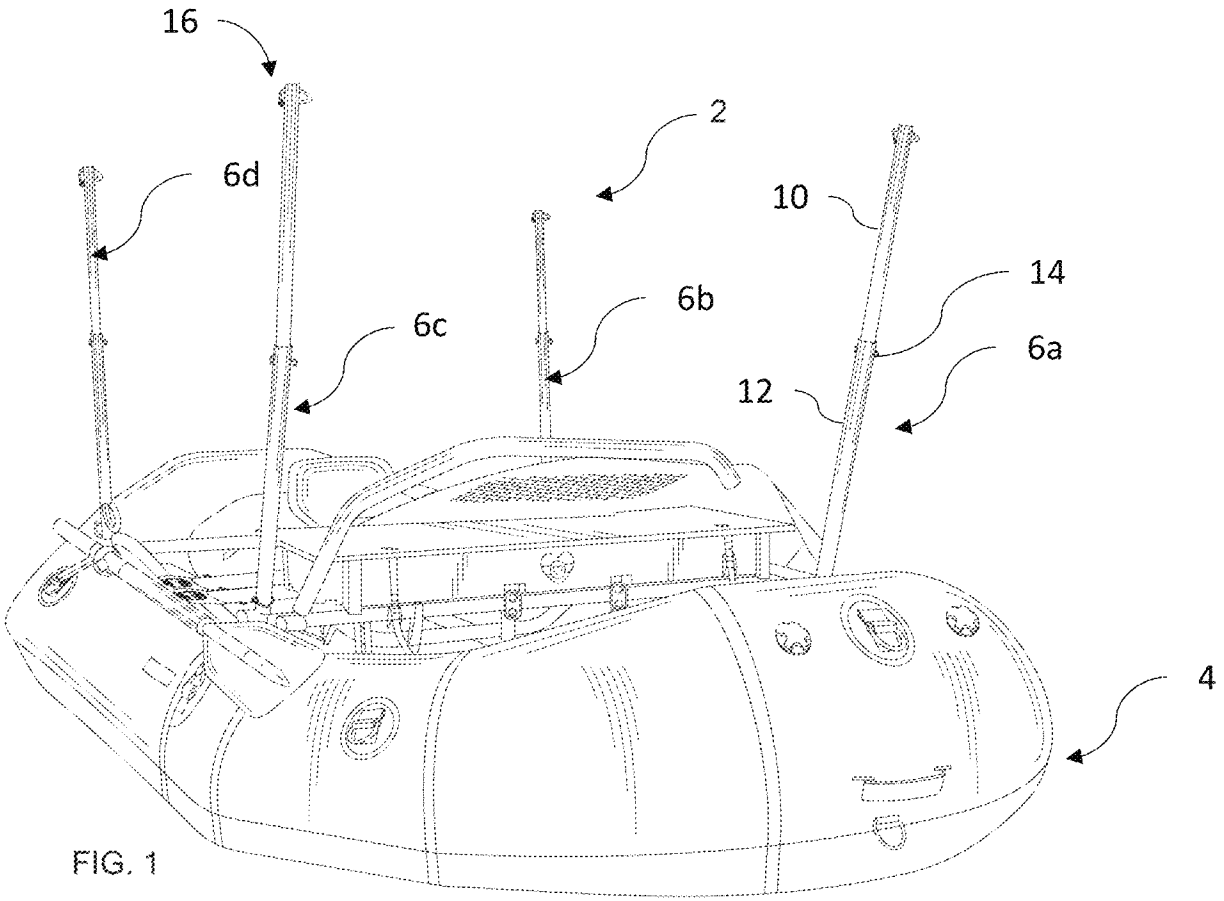
FIG. 1 is a perspective view of a portion of a covering system according to one embodiment of the present disclosure shown in combination with a raft.

FIG. 1 is a perspective view of a portion of a shade and covering system 2 according to one embodiment of the present disclosure. As shown, the system 2 is provided in combination with a watercraft 4 which is depicted as a raft in FIG. 1. It will be recognized, however, that systems of the present disclosure can be provided with various objects and devices including different watercraft, fixed objects, semi-fixed objects (e.g. tables). Accordingly, the raft 4 of FIG. 1 is shown for illustrative purposes and no limitation is provided herewith with respect to the intended use of the system 2.

As shown in FIG. 1, the system 2 comprises a plurality of upright supports 6*a*, 6*b*, 6*c*, 6*d*. The upright supports 6 are contemplated as being selectively connected to a pre-existing frame 8 of a watercraft 4 (for example) or other pre-existing component. The connection between the upright supports 6 and the frame of the watercraft is not detailed in FIG. 1 and will be described later. The upright supports 6 of FIG. 1 are contemplated as comprising telescoping members wherein a first portion 10 and a second portion 12 of each of the upright members are selectively translatable relative to one another and can be secured in a plurality of different relative positions. The first portion 10 and second portion 12 are selectively securable via pins 14 operable to extend through at least a portion of the first members and the second members. The upright members 6 are contemplated as comprising supports that extend vertically above a device 4. The distal ends 16 of the supports 6 are contemplated as comprising connection points for a covering (for example). It is also contemplated, however, that frame components including upright supports and related connection members are suitable for supporting various objects including, for example, fishing rods, flags, lights, storage accessories, speakers, drink holders, and sails.

Figure 2:
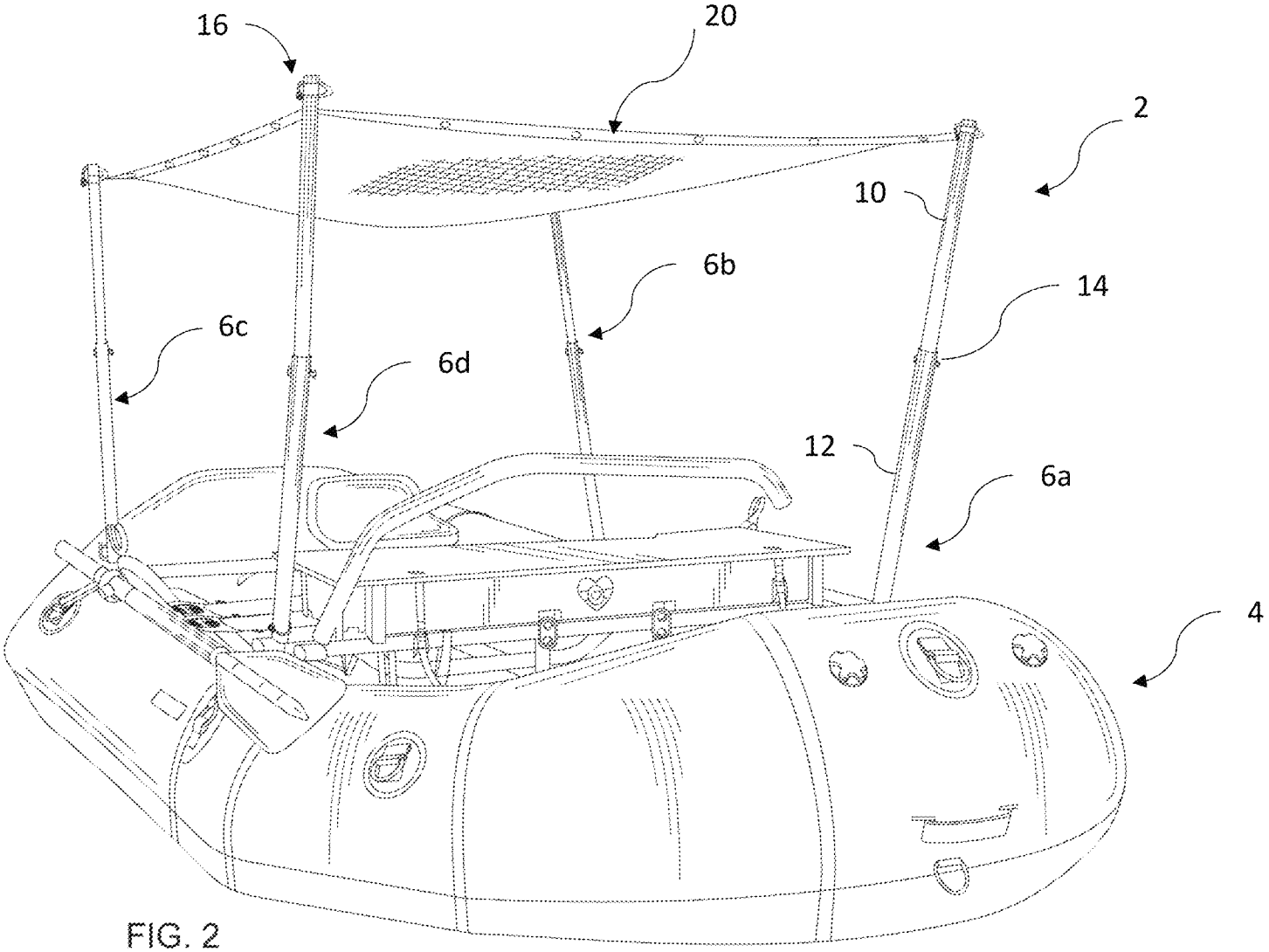
FIG. 2 is a perspective view of a covering system according to an embodiment of the present disclosure shown in combination with a raft.

FIG. 2 is a perspective view of the system 2 and watercraft 4 according to the embodiment of FIG. 1. As shown in FIG. 2, a cover member 20 is provided. The cover member 20 extends between and is connected to at least some of the plurality of upright supports 6 to span an area over the watercraft 4 and provide covering and shade thereto. Although four upright supports 6 and a generally rectangular cover 20 are shown in FIG. 2, the present disclosure is not limited to such arrangements. Greater or fewer than four upright supports are contemplated, as are different shaped coverings 20. The covering 20 is contemplated as comprising various materials. For example, the covering 20 may comprise a lightweight porous member that is suitable for providing shade and sun protection. The covering 20 is also contemplated as comprising a water resistant or waterproof covering to repel sun and water.

Embodiments of the present disclosure provide supports structures and connection members that facilitate the support of a shade or cover member 20 in various positions. As shown and described herein, various components of the present disclosure allow for positioning and repositioning of a cover by allowing selective rotation of upright support members 6 as well as selective expansion and contraction of the supports 6.

Figure 3:
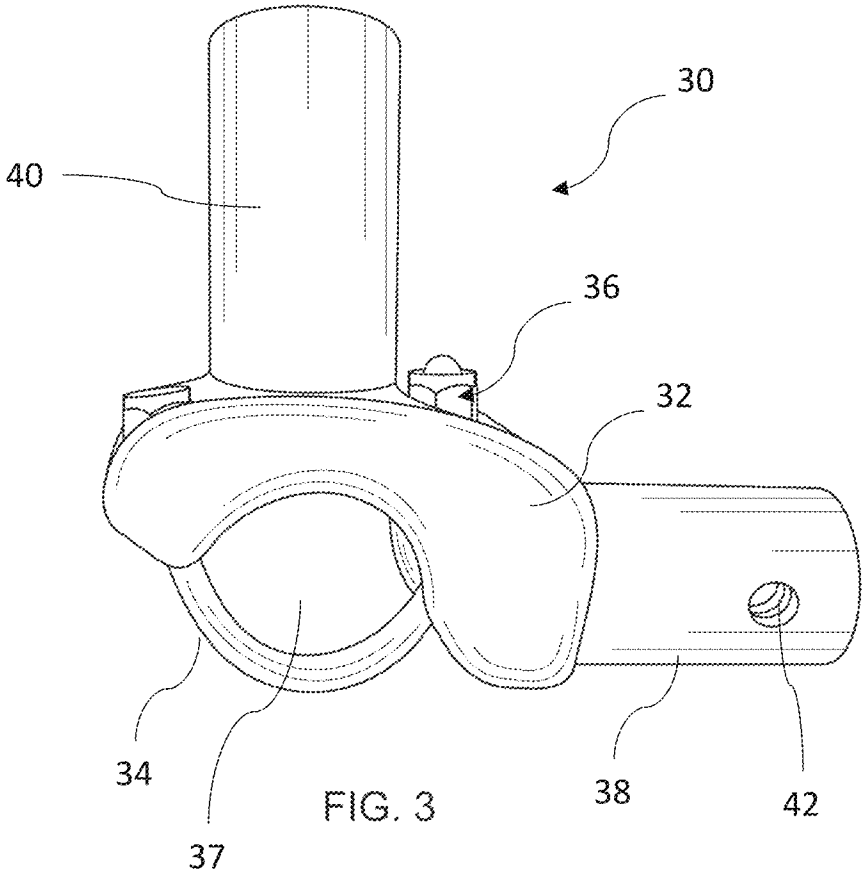
FIG. 3 is a side view of a component of a covering system according to one embodiment of the present disclosure.

FIG. 3 is a side elevation view of an attachment member 30 according to an embodiment of the present disclosure. As shown, the attachment member 30 comprises a central hub portion 32 and is securable to various objects including, for example, round frame members. Specifically, the hub portion 32 comprises a clamp 34. The clamp 34 comprises a curved member that is tightened and secured by at least one fastener 36. The clamp 34 provides a female receiving area 37 at least when secured and allows the member 30 to be secured to an object or pre-existing component. The attachment member 30 further comprises a first male extension 38 and a second male extension 40. The male extensions 38, 40 are operable to receive one or more support members including, for example, the upright support members 6 of FIG. 1. The first and second male extensions 38, 40 comprise apertures 42 to receive a pin, for example, and secure the support members. The first and second male extensions 38, 40 are each operable to receive and secure an additional member. In some embodiments, it is contemplated that the second male extension 40 is operable to support an upright 6 in a position of use wherein the support extends above an object, while the second male extension 38 is operable to receive a support 6 in a storage position when the system is to be stowed.

Figure 4:
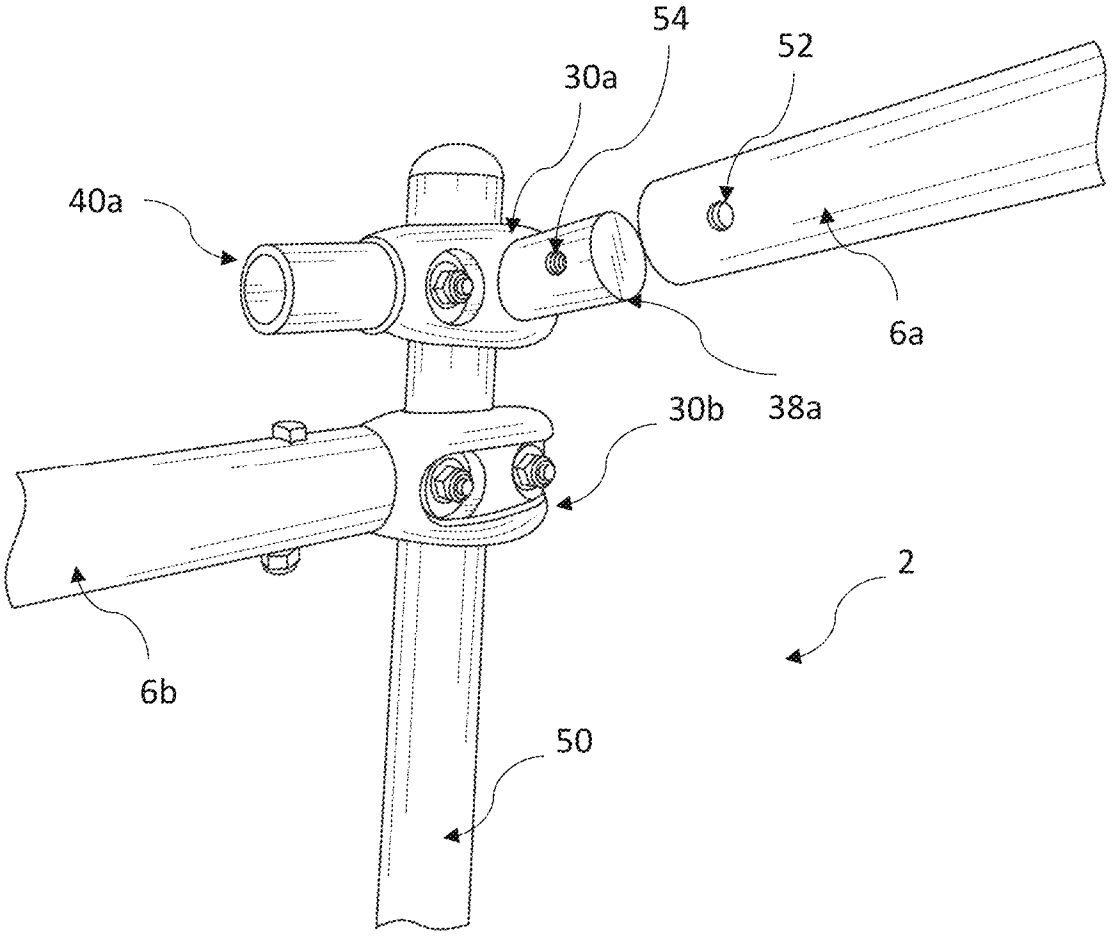
FIG. 4 is a partially exploded view of a portion of a covering system according to one embodiment of the present disclosure.

FIG. 4 is a perspective view of a system 2 according one embodiment of the present disclosure and wherein attachment members 30 are shown relative to additional components including a frame member 50 and members 6*a*, 6*b*.

The frame member 50 is contemplated as comprising but is not limited to an internal frame member of a raft. The system of FIG. 4 comprises at least one attachment member 30*a* comprising first and second male extensions 38*a*, 40*a*. A support 6*a* is provided that is operable to be secured to a first male extension 38*a*. A second male extension 40*a* is provided and is contemplated as being useful for or operable to secure the support 6*a* in a storage position when the support is not needed or desired. The support 6 is securable to the attachment member 30*a* by providing a fastener (e.g. a threaded fastener) through an aperture 52 in the support 6 and an aperture 54 in the attachment member 30*a*. The first male extension 38*a* is illustrated as comprising a solid or substantially solid extension, while the second male extension 40*a* comprises a hollow or at least partially hollow extension. Alternatives are contemplated. In some embodiments, both extensions comprise solid or hollow extensions.

A second attachment member 30*b* is provided. The second attachment member 30*b* is secured or clamped to the frame member 50. The second attachment member 30*b* is contemplated as comprising as few as one male extensions to which a support 6*b* is secured. The support 6*b* can be secured to the attachment member 30*b* to stow the support 6*b* and/or to provide a structural member (e.g. a cross-bar for supporting the frame generally).

Figure 5:
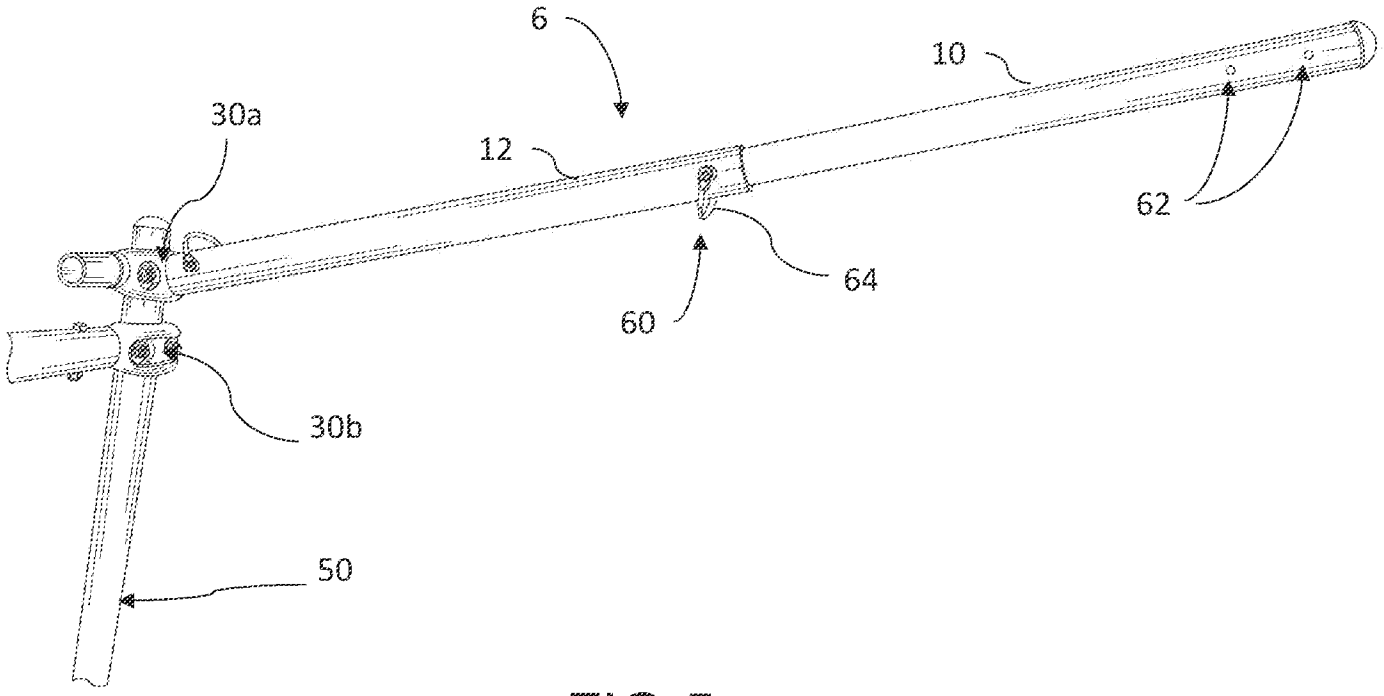
FIG. 5 is a perspective view of a portion of a covering system according to one embodiment of the present disclosure.

FIG. 5 is a perspective view of a portion of a system according to one embodiment of the present disclosure. Various components shown and described with respect to FIGS. 1-4 are labeled in FIG. 5, and the discussion from FIGS. 1-4 is incorporated by reference. As shown in FIG. 5, a first support 6 comprises a first portion 10 and a second portion 12 extending from an attachment member 30*a*. The attachment member is secured to a frame member 50. The first portion 10 is translatable relative to at least the second portion 12. The first portion 10 is secured at a desired relative position by a pin 60 that extends through apertures in the first portion 10 and the second portion 12. As shown in FIG. 5, a plurality of apertures 62 are provided to allow a user to position and secure the first portion 10 in various different positions relative to the second portion 12. The pin 60 is shown as comprising a tether 64. The tether 64 is operable to extend between a first end and a second end of the pin 60 and secure the pin in place. The tether 64 is contemplated as comprising various materials. In some embodiments, the tether 64 comprises a rubber or elastic securing member that is selectively securable to at least one end of the pin such that the pin 60 may be inserted through the first portion and second portion and secured by the tether 64 once the components are assembled. When not provided with a pin 60, apertures 62 of the system are operable to receive and support other objects such as shade coverings, carabiners, etc.

Figure 6:
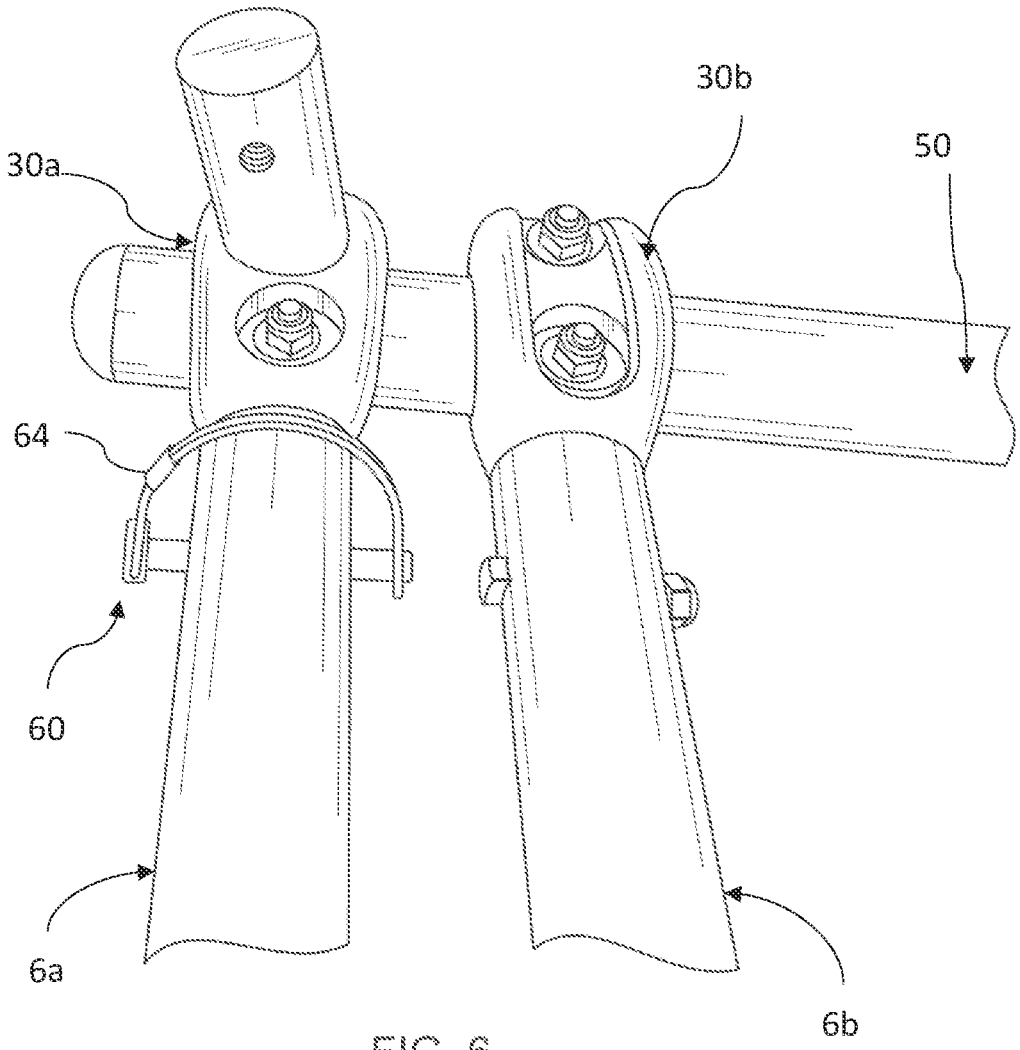
FIG. 6 is a perspective view of a portion of a covering system according to one embodiment of the present disclosure.

FIG. 6 is a perspective view of components of a system according to one embodiment of the present disclosure. As shown in FIG. 6, an attachment member 30*a* is shown with a support 6*a* secured to the attachment member 30*a* in a storage position. The first support 6*a* extends substantially parallel to a second support member 6*b* and both supports 6 extend substantially coplanar with the frame member 50 as opposed to the upwardly extending support position shown in FIG. 1, for example.

Figure 7:
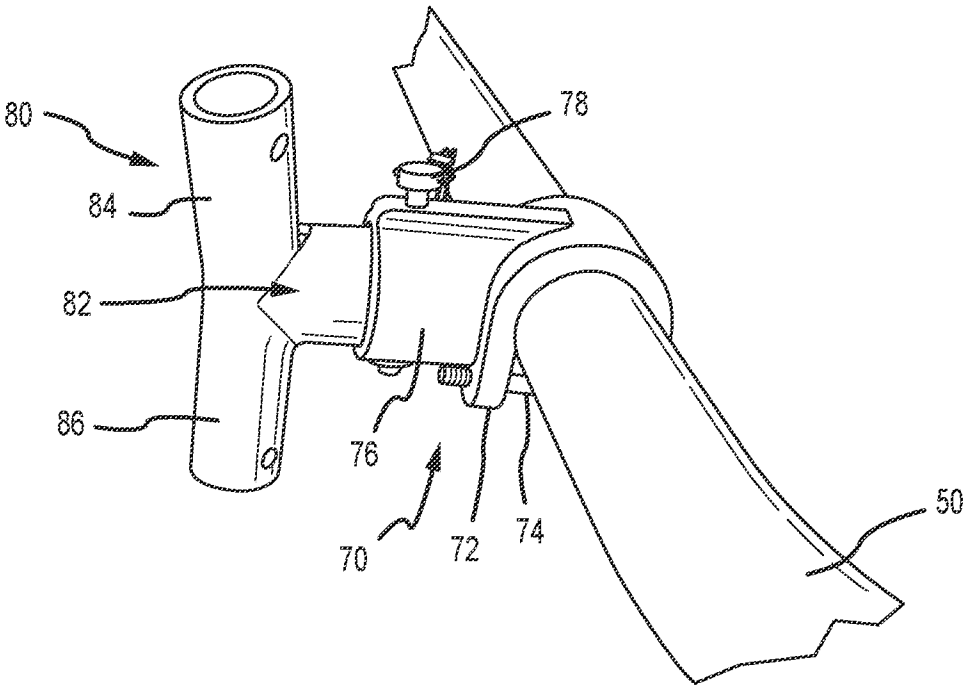
FIG. 7 is a perspective view of portions of a covering system according one embodiment of the present disclosure.

FIG. 7 is a perspective view of components of a covering system attached to a frame member 50. As shown, an attachment member 70 is provided and is secured to the frame member 50. The attachment member 70 of FIG. 7 comprises a C-shaped clamp portion 72 and a fastener 74 for securing the attachment member 70 to a tubular frame member (for example). The attachment member 70 may be provided in various positions but is shown as extending outboard of the frame 70 in FIG. 7. The attachment member 70 comprises an at least partially hollow main body portion 76 with a female aperture. A support member 80 is secured to the attachment member 70 and the frame 50. The support member 80 of the embodiment of FIG. 7 comprises a male extension 82 and first and second attachment portions 84, 86 extending therefrom. The attachment portions 84, 86, which are shown and described in more detail herein, are operable to support various objects at various angles and are rotatable relative to the frame 50 by rotating the support member 80 about a longitudinal axis of the male extension 82. Although the extensions of various embodiments are contemplated as comprising male extensions that are operable to extend into additional components, the present disclosure is not limited to such "male" extensions. Indeed, it is contemplated that attaching portions 84, 86 (for example) comprise extensions with a female aperture for receiving additional components including, for example, upright members for supporting a canopy or cover.

Figure 8:
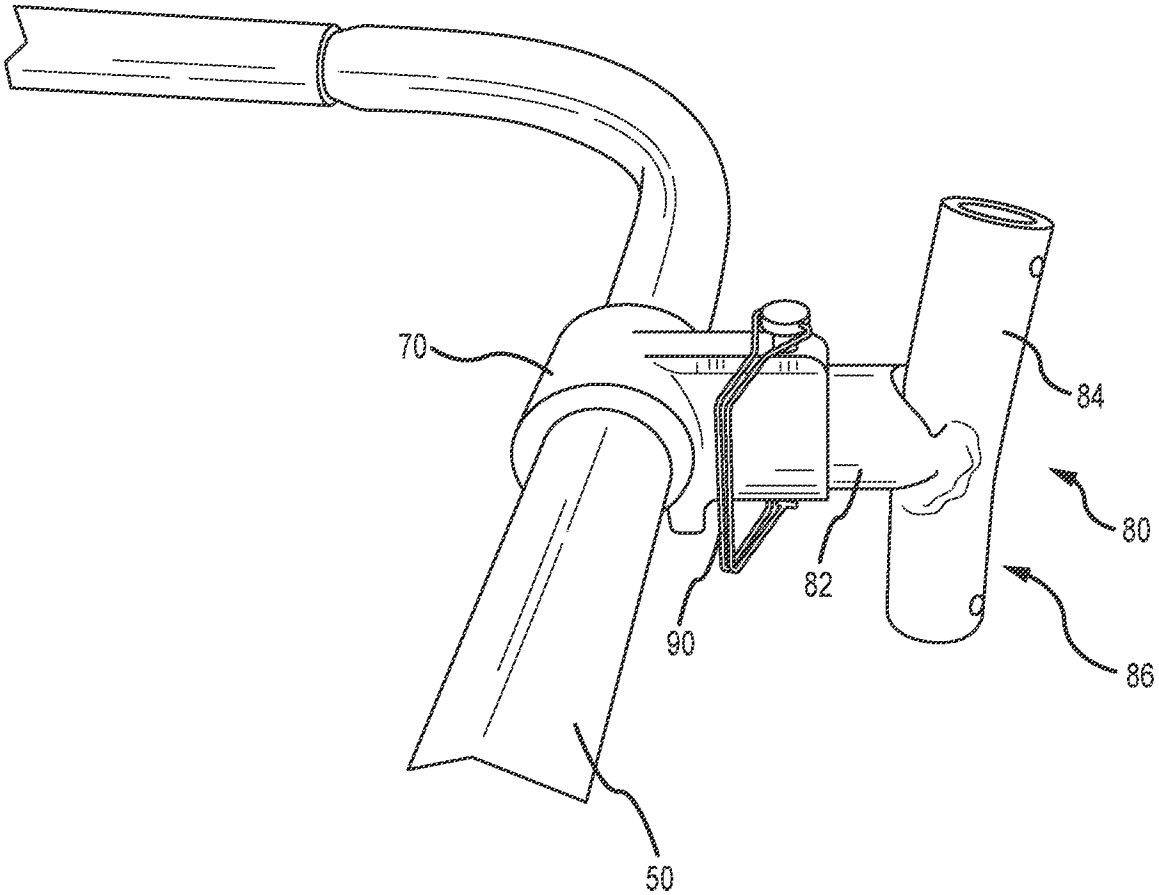
FIG. 8 is a perspective view of portions of a covering system according one embodiment of the present disclosure.

FIG. 8 is a perspective view of the attachment member 70 and support member 80 according to the embodiment of FIG. 7. As shown, the support member 80 is secured to the frame 50 via the attachment member 70. A male extension 82 of the support member 80 extends into the attachment member 70 and the male extension is secured by a pin 90 or clevis. The male extension 82 of the support member 80 is contemplated as comprising a plurality of apertures for selectively securing the support member 80 to the attachment member 70 at a plurality of rotational positions or orientations.

Figure 9:
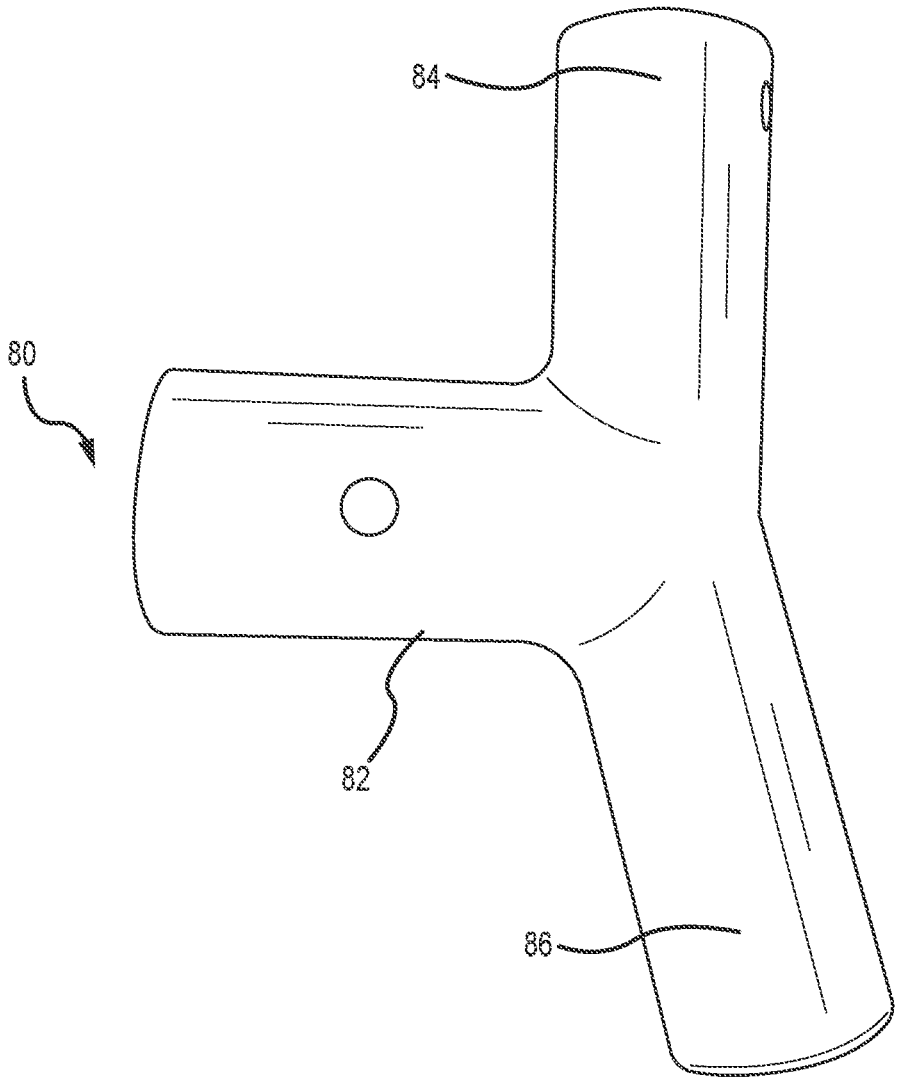
FIG. 9 is a plan view of a component of a covering system according to one embodiment of the present disclosure.

FIG. 9 is a plan view of a support member 80. As shown, the support member 80 comprises a male extension 82 and first and second attachment portions 84, 86. As shown, the first attachment portion 84 extends at an angle relative to the male extension 82 that is approximately a right angle. The second attachment portion 86 extends at a second angle to the male extension 82, and wherein the second angle comprises an oblique angle that is greater than ninety degrees and wherein the second attachment portion 86 is provided at an angle with the first attachment portion. In preferred embodiments, the first and second attachment portions 84, 86 comprise fixed angles wherein the angle of the attachment portion relative to the male extension 82 is fixed. However, the position of the first and second attachment portions 84, 86 are adjustable by rotation of the support member 80 relative to a frame. More specifically, the male extension 82 can be rotated about its longitudinal axis relative to the attachment member 70 and frame, thereby changing the position and angle of the first and second attachment portions 84, 86 relative to a remainder of the system. The first attachment member 84 is contemplated as but is not limited to being provided as a horizontal support member for storing articles. The second attachment member 86 is contemplated as but is not limited to being provided as an upright support for supporting a shade element or similar article. It will be recognized, however, that no limitation with respect to these intended uses is provided. For example, the first attachment member 84 can be provided in an upright position to provide a support for a shade that extends substantially perpendicular to a frame member.

Figure 10:
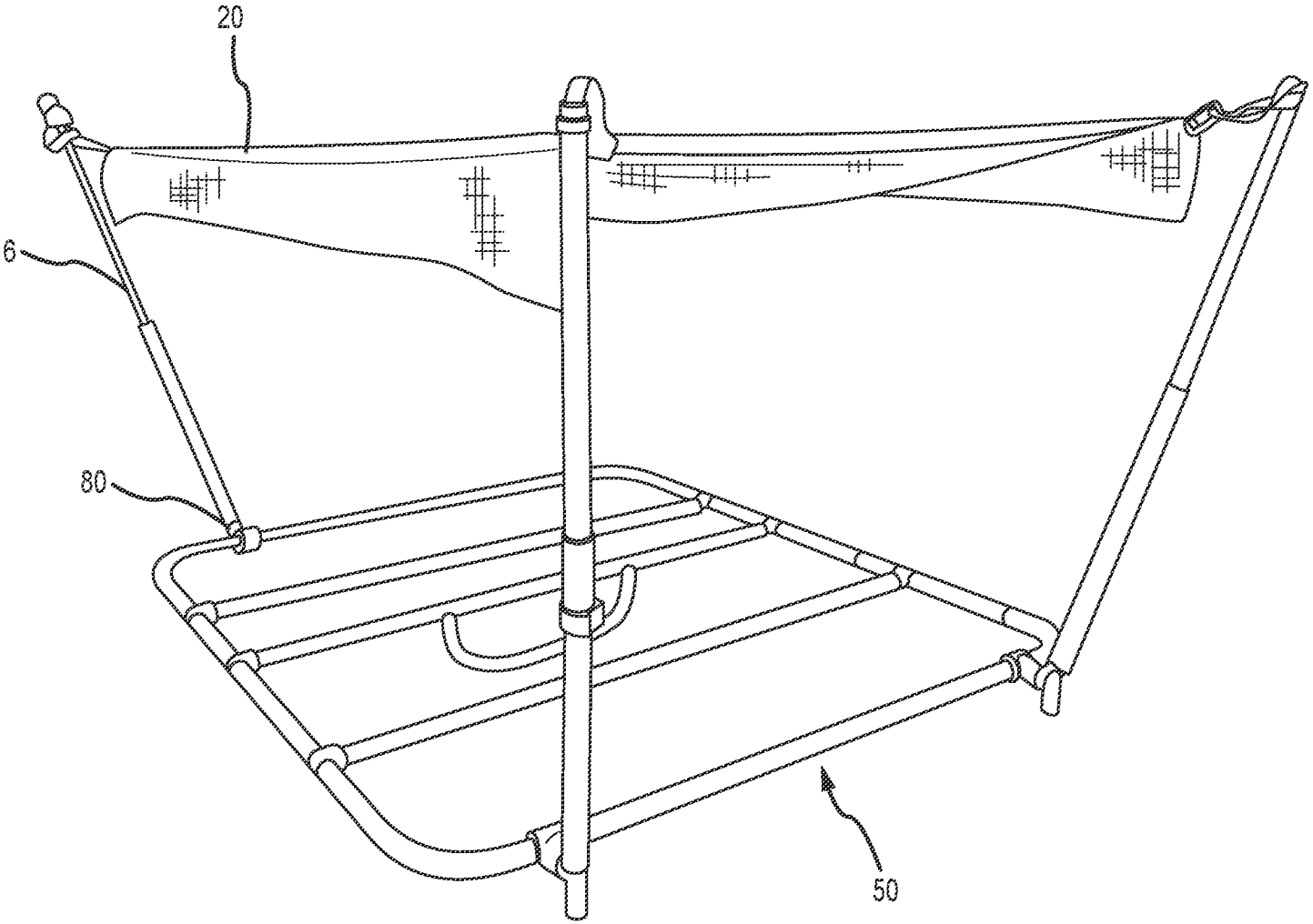
FIG. 10 is perspective view of a covering system according to one embodiment of the present disclosure.

FIG. 10 is a perspective view of a system 2 according to one embodiment of the present disclosure. As shown, the system 2 comprises a shading system with a plurality of upright supports 6 extending from a frame member 50. The supports 6 are secured to the frame 50 by support members 80 as shown in FIGS. 7 and 8 (for example). The support members 80 are provided and positioned to extend outboard of the frame member 50. The second attachment portions 86 are provided in an upright position, and wherein the second attachment portions 86 extend at an upward and outward angle such that the supports 6 extend upward and outboard from a center of the frame member.

Although not shown in FIG. 10, the support members 80 are operable to be provided in a second position. The second position comprises a storage position wherein the attachment member 70 is rotated approximately ninety degrees such that the first attachment member 84 extends substantially parallel to the lateral frame members. Additionally, the attachment members 70 can be rotated and/or repositioned such that that they extend inboard of the frame member (or extend in another direction) based on user preference.

Figure 11:
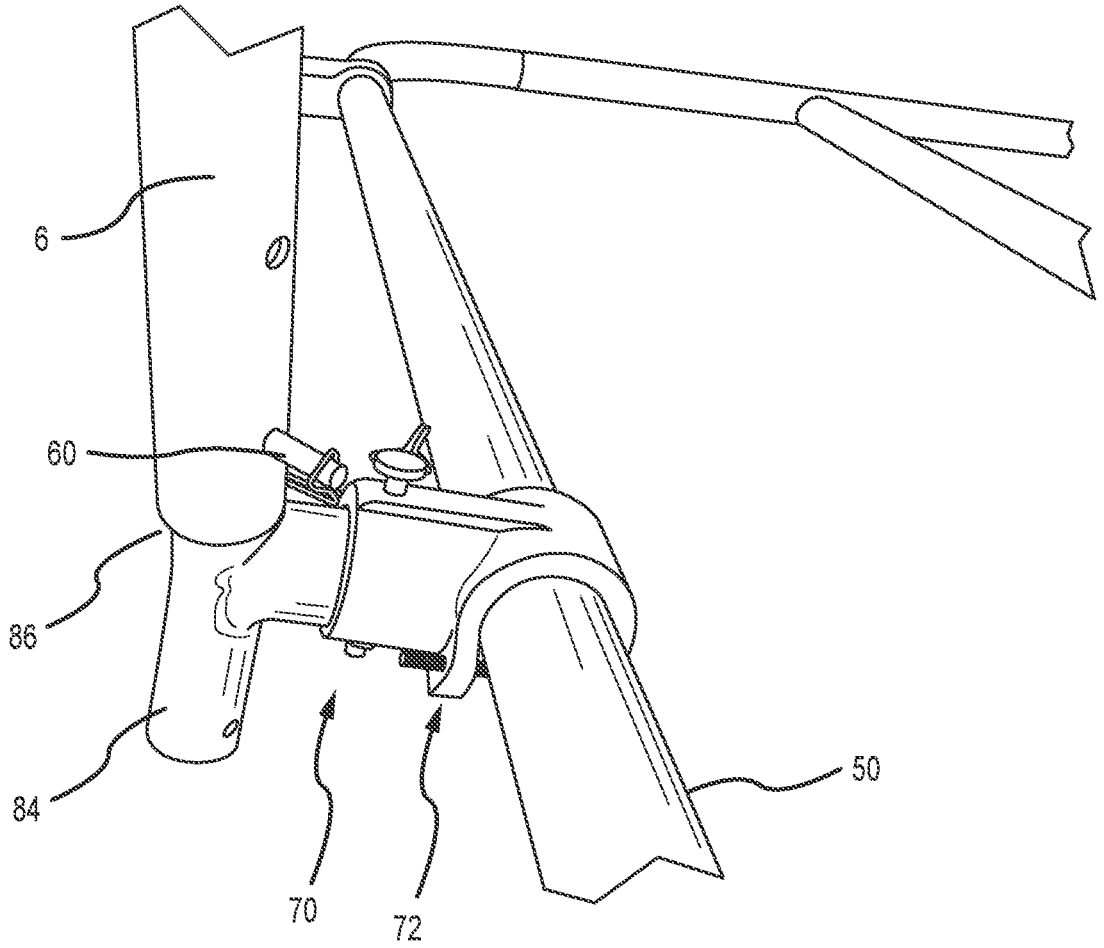
FIG. 11 is a perspective view of portions of a covering system according one embodiment of the present disclosure.
Figure 12:
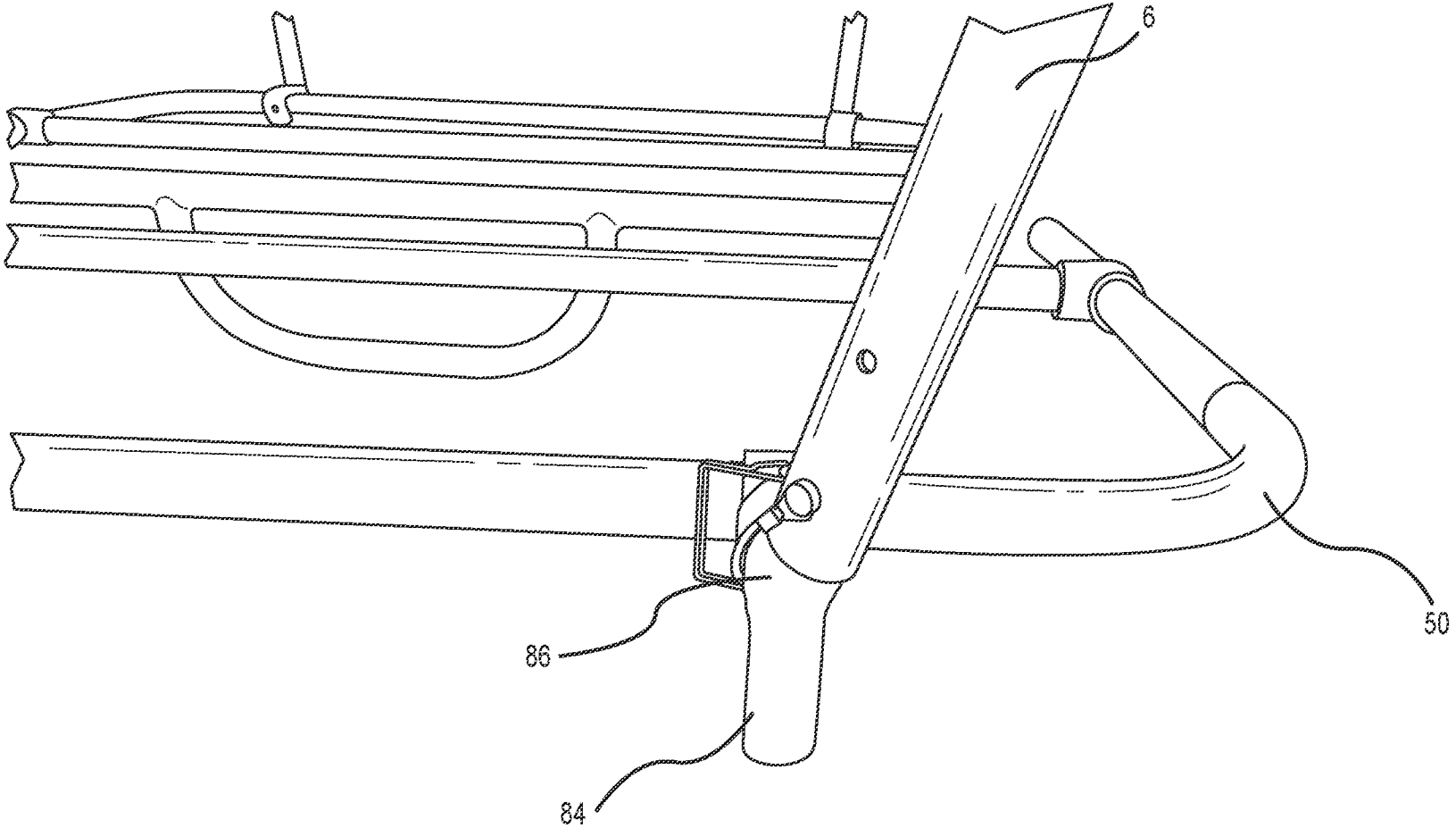
FIG. 12 is a perspective view of portions of a covering system according one embodiment of the present disclosure.

FIGS. 11-12 are detailed perspective views of a system according to one embodiment of the present disclosure. As shown, a frame member 50 is provided. An attachment member 70 is provided and is shown in more detail in FIG. 7. A support member 80 is secured to the attachment member 70, and the support member 80 comprises first and second attachment portions 84, 86. The support member 6 is contemplated as comprising a support member for a shading cover or various other articles. A pin 60 is provided to secure the support 6 to the second attachment portion 86. In various embodiments, it is contemplated that a system is provided comprising four attachment members 70 and four support members 80. However, alternative embodiments are contemplated wherein as few as one attachment member 70 and one support member 80 are provided to support a single element (e.g. a light or flagpole). Further embodiments contemplate the provision of more than four supports for larger vessels or where a large amount of weight is to be supported (for example).

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity so as to not confuse the reader, and it is not intended that such claim term by limited, by implication or otherwise, to that single meaning.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention.

What is claimed is:

1. A system for providing at least one of covering and shade, the system comprising:
   - an attachment member comprising a clamp and a fastener and wherein the attachment member is operable to be selectively secured to a pre-existing component and operable to receive a support member;
   - a support member comprising a male extension operable to be received by the attachment member, a first attachment portion and a second attachment portion;
   - a telescoping extension member;
   - wherein the first and second attachment portions of the support member are operable to be secured to the telescoping extension member; and
   - a textile canopy member selectively secured to the telescoping extension member and operable to provide at least one of shade and cover.

2. The system of claim 1, wherein the pre-existing component comprises an internal frame member of a raft.

3. The system of claim 1, wherein the system comprises at least two telescoping members translatable relative to one another and selectively securable by a pin.

4. The system of claim 1, wherein the first attachment portion extends in a first direction and the second attachment portion extends in a second direction.

5. The system of claim 4, wherein the first direction and the second direction are at least 45 degrees apart.

6. The system of claim 1, wherein support member is selectively secured to the attachment member.

7. The system of claim 1, wherein the male extension is operable to extend into the attachment member.

8. A system for providing at least one of covering and shade, the system comprising:
   - a plurality of attachment members, wherein each of the plurality of attachment members comprise:
     - a clamp and a fastener and wherein each of the attachment members are operable to be selectively secured to a tubular frame member; and
     - a first male extension and a second male extension, and wherein at least a portion of the attachment members are rotatable to selectively position at least one of the first male extension and the second male extension in a position of use;
   - a plurality of support members operable to extend from the attachment members;
   - wherein the first and second male extensions of the attachment members are operable to be secured to at least one of the support members.

9. The system of claim 8, wherein a textile canopy member is selectively secured to the plurality of support members to provide at least one of shade and cover.

10. The system of claim 8, wherein the tubular frame member comprises an internal frame member of a raft.

11. The system of claim 8, wherein the plurality of support members each comprise two telescoping members translatable relative to one another and selectively securable by a pin.

12. The system of claim 8, wherein the first male extension extends in a first direction and the second male extension extends in a second direction.

13. The system of claim 8, wherein the first male extension and the second male extension both extend at an angle from a third male extension and wherein the third male extension is operable to extend into the attachment member.

14. A frame system for a water craft, the frame system comprising:
   - at least one tubular frame member extending along at least one of a length and a width of the water craft;
   - a clamp that is selectively securable to the at least one tubular frame member;
   - a plurality of attachment members, wherein each of the plurality of attachment members comprise a plurality of extensions;

the plurality of extensions comprising a first extension that is operable to be secured to the clamp, a second extension that extends away from a longitudinal axis of the first extension, and a third extension that extends away from the longitudinal axis of the first and second extension;

wherein each of the attachment members is rotatable about the longitudinal axis of the first extension and a position of the second and third extensions are selectively adjustable based on said rotation;

a plurality of support members operable to extend from the attachment members and the tubular frame member, wherein the plurality of support members each comprise a distal end operable to receive and support at least one of a cover and a canopy.

15. The frame system of claim 14, wherein the at least one tubular frame member comprises an internal frame member of a raft.

16. The frame system of claim 14, wherein the support members comprise telescoping members.

17. The frame system of claim 14, wherein the first extension is provided perpendicular to the second extension.

18. The frame system of claim 14, wherein the second extension comprises a male extension operable to extend into and connect to one of the plurality of support members.

19. The frame system of claim 14, wherein the third extension comprises a male extension.

* * * * *